US010895378B1

(12) United States Patent
Torres et al.

(10) Patent No.: US 10,895,378 B1
(45) Date of Patent: Jan. 19, 2021

(54) DECORATIVE ELECTRONIC LAMP

(71) Applicants: Raul Torres, Colton, CA (US); Juan Sevilla, Upland, CA (US)

(72) Inventors: Raul Torres, Colton, CA (US); Juan Sevilla, Upland, CA (US)

( * ) Notice: Subject to any disclaimer, the term of this patent is extended or adjusted under 35 U.S.C. 154(b) by 0 days.

(21) Appl. No.: 16/705,836

(22) Filed: Dec. 6, 2019

(51) Int. Cl.

| | |
|---|---|
| ***F21V 33/00*** | (2006.01) |
| ***F21S 6/00*** | (2006.01) |
| ***F21S 4/10*** | (2016.01) |
| ***F21W 121/00*** | (2006.01) |

(52) U.S. Cl.
CPC ..... *F21V 33/0028* (2013.01); *F21S 6/002* (2013.01); *F21S 4/10* (2016.01); *F21W 2121/00* (2013.01)

(58) Field of Classification Search
CPC F21V 4/08; F21V 33/0028; F21L 4/08; F21S 6/002; F21S 4/10; F21W 2121/00
See application file for complete search history.

(56) References Cited

U.S. PATENT DOCUMENTS

| | | | | |
|---|---|---|---|---|
| 4,758,934 | A | 7/1988 | Von Kohorn | |
| 5,589,734 | A | 12/1996 | Deisenhofer | |
| 6,116,751 | A | 9/2000 | Remp | |
| 6,168,290 | B1 * | 1/2001 | Christiansen | F21V 7/0008 362/253 |
| 6,409,359 | B1 * | 6/2002 | O'Connell | G09F 13/04 362/145 |
| 6,890,088 | B2 * | 5/2005 | Santa Cruz | F21S 9/02 362/153.1 |
| 7,175,793 | B1 * | 2/2007 | Reed | B28B 7/346 264/220 |
| 9,115,856 | B1 * | 8/2015 | Robinson | F21L 4/08 |

* cited by examiner

*Primary Examiner* — Peggy A Neils
(74) *Attorney, Agent, or Firm* — Sanchelima & Associates, P.A.; Christian Sanchelima; Jesus Sanchelima

(57) ABSTRACT

A decorative electronic lamp including one or more stone portions arranged in a defined pattern and a wiring housing is disclosed. At least one stone portion of one or more stone portions includes a provision for the installment of at least one light source or one or more light sources. The wiring housing is configured to house electrical wires extending from one or more light sources to an electrical power supply through one or more stone portions.

10 Claims, 4 Drawing Sheets

DECORATIVE ELECTRONIC LAMP

BACKGROUND OF THE INVENTION

1. Field of the Invention

The present disclosure relates to a decorative electronic lamp. More particularly, the present disclosure relates to decorative electronic lamp including one or more stone portions.

2. Description of the Related Art

Recently, a variety of decorative electronic items are catching the fancy of customers. However, such decorative electronic items are mainly made up of plastic or metals that are non-reusable, and in the long run, harm the environment.

Applicant believes that a related reference corresponds to U.S. Pat. No. 6,116,751 that discloses a lighted landscaping stone, U.S. Pat. No. 4,758,934 that discloses an illuminated rock garden support, U.S. Pat. No. 5,589,734 discloses an electric lamp having a fluorescence-suppressed quartz-glass envelope, and quartz glass therefor.

However, none of the above references discloses a decorative electronic item that is novel in design and comprising one or more stone portions having additional members, such as a transparent glass cylinder, mounted on top and another stone portion mounted atop the glass cylinder. The first stone portion has an aperture extending through the center from the top to the bottom for housing electrical wires which power at least one light emitting diode housed within the glass cylinder. The electrical wires may be connected to a solar cell-type power source or a conventional electrical power source external to the stone lamp body.

Other documents describing the closest subject matter provide for a number of more or less complicated features that fail to solve the problem in an efficient and economical way. None of these patents suggest the novel features of the present invention.

SUMMARY OF THE INVENTION

It is an object of present invention to provide a decorative electronic lamp including one or more stone portions arranged in a defined pattern and a wiring housing. At least one stone portion of one or more stone portions includes a provision for installment of at least one light source of one or more light sources. Wiring housing may be configured to house electrical wires extending from one or more light sources to an electrical power supply through one or more stone portions.

In an embodiment, one or more stone portions belong to a single stone body aesthetically disintegrated in defined pattern. In an embodiment, defined pattern may correspond to positioning of at least one light source on top end of at least one stone portion, mounting of a glass cylinder over top end of at least one stone portion, and mounting another stone portion atop glass cylinder. In an embodiment, defined pattern may correspond to positioning of at least one light source on top end of at least one stone portion, mounting of a plurality of support members over top end of at least one stone portion, and mounting another stone portion atop plurality of support members.

In an embodiment, one or more stone portions correspond to different stone bodies aesthetically arranged in defined pattern. In an embodiment, defined pattern may correspond to an aperture through transverse surface of at least one stone portion of one or more stone portions. At least one light source is positioned in the aperture.

In an embodiment, electrical wires may be connected to a solar cell-type power source. In another embodiment, electrical wires are connected to an external electrical power source.

In an embodiment, each of one or more stone portions are of a regular shape or an irregular shape.

Further objects of invention will be brought out in following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
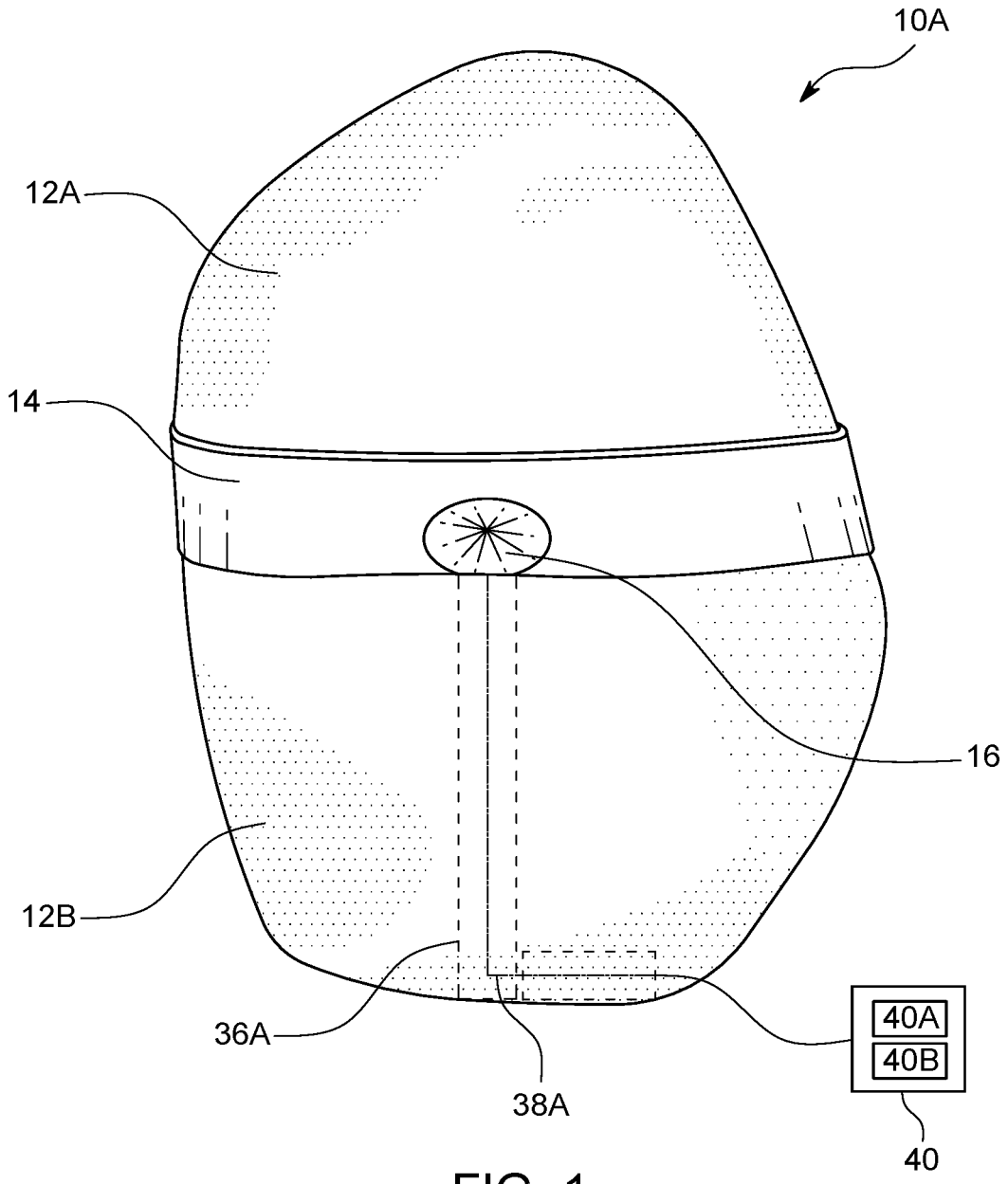
FIGS. 1 to 1C represent various exemplary decorative electronic lamps 10A to 10D of present invention, according to various embodiments described herein.

Referring now to the drawings, FIGS. 1 to 1C, where the present invention is generally referred to with numerals 10A to 10D respectively, it can be observed that a decorative electronic lamp, in accordance with one embodiment, is provided that includes various components, a described hereinafter.

Figure 1A:
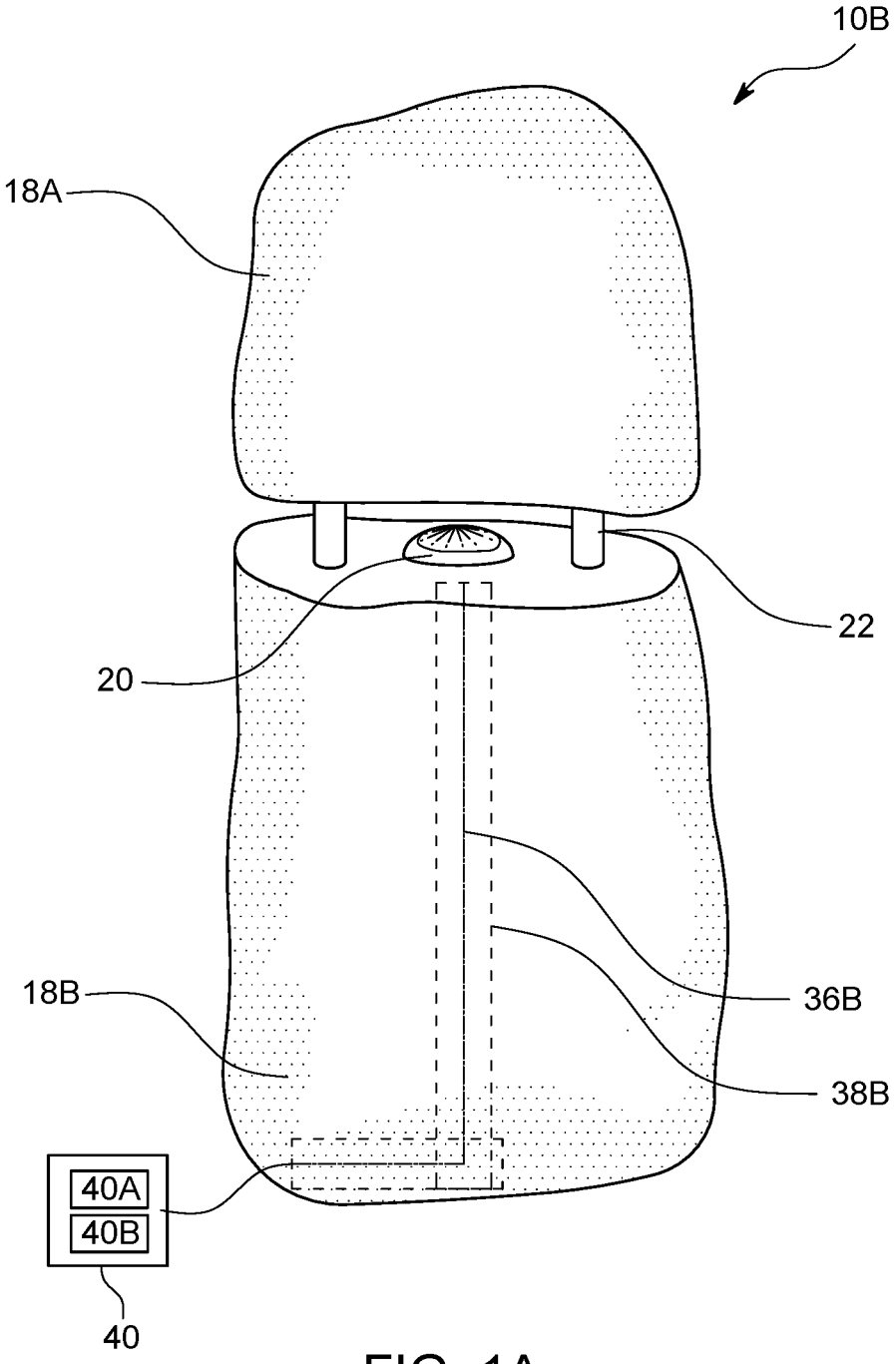
Figure 1B:
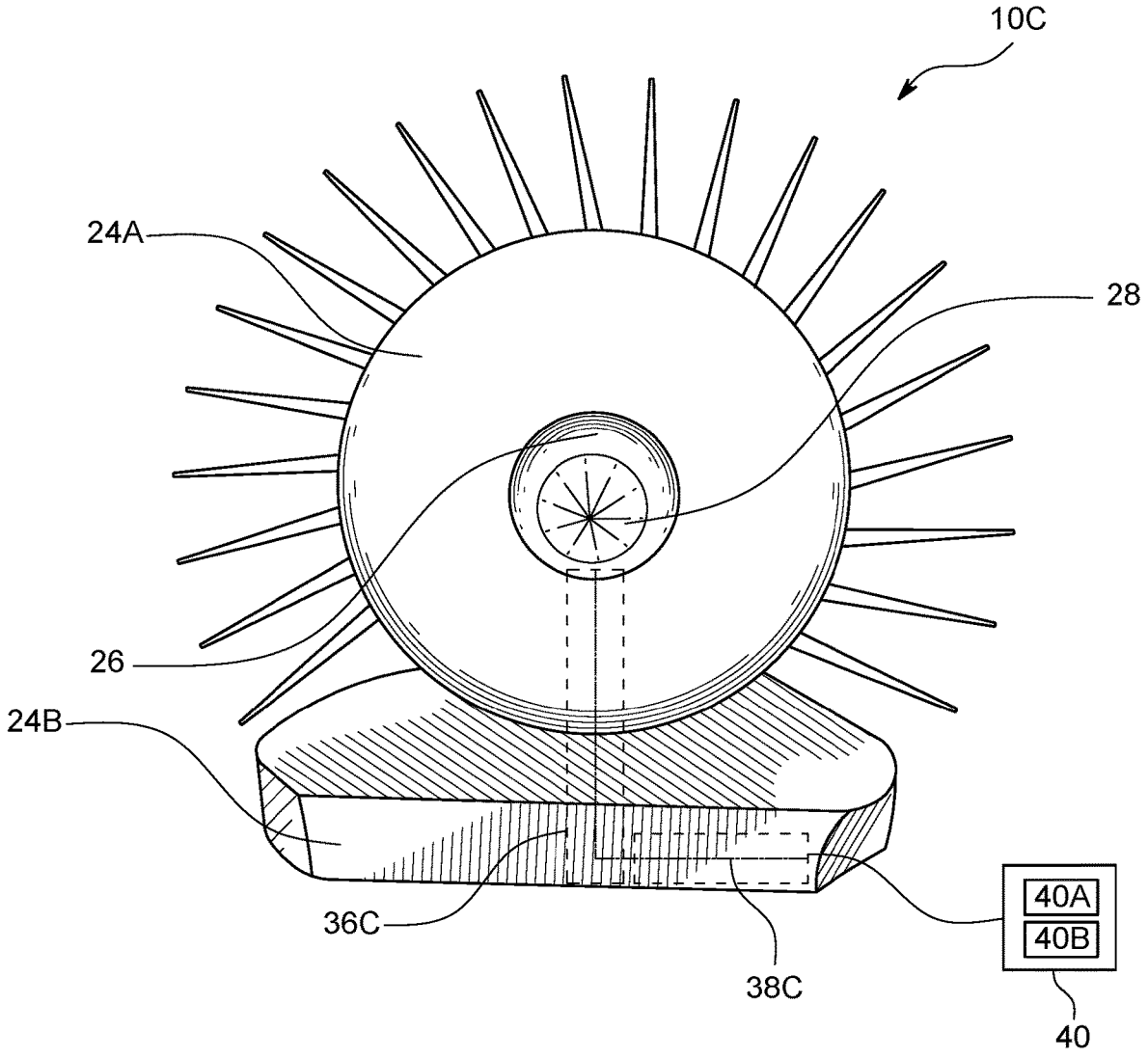
Figure 1C:
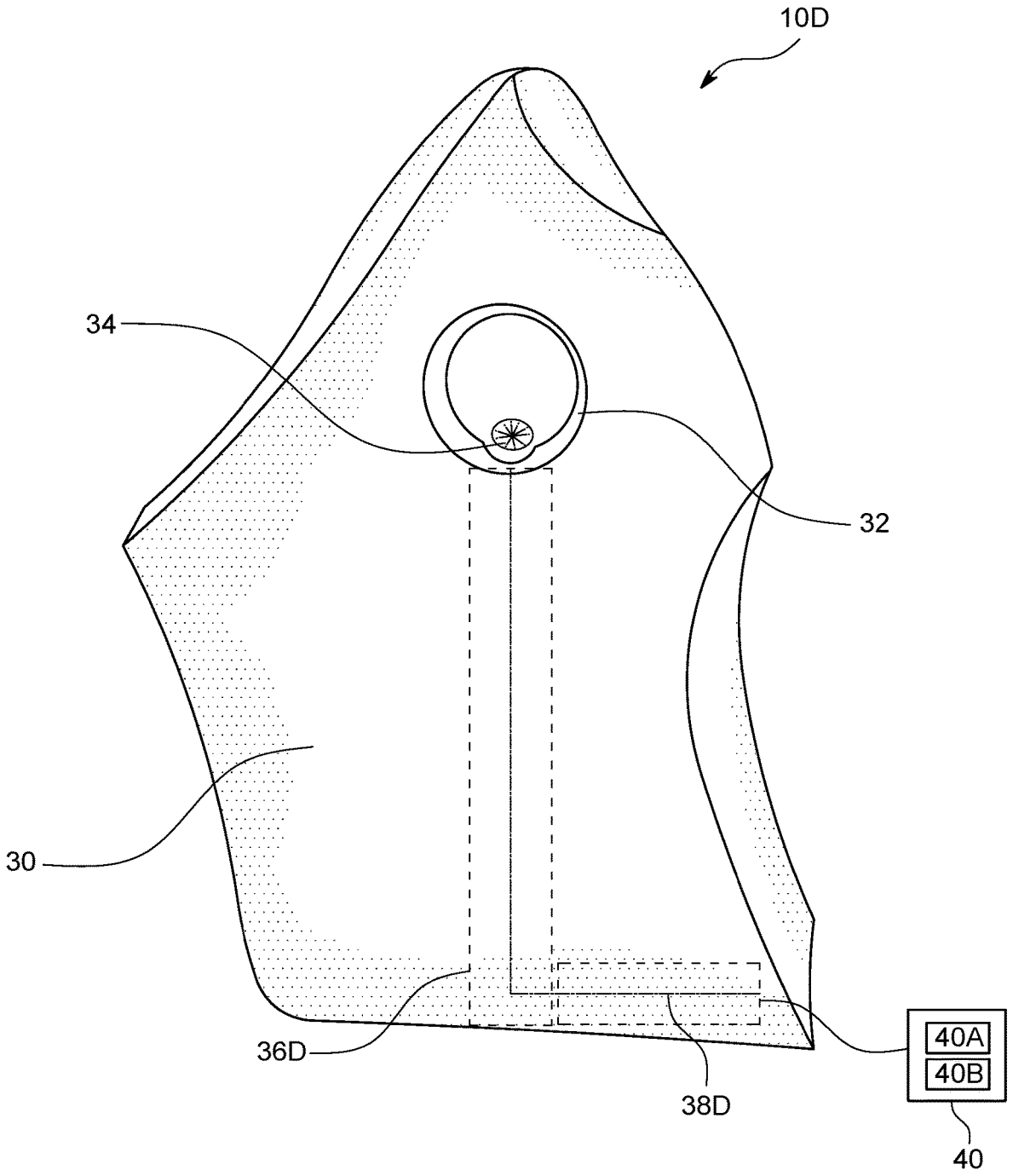

FIGS. 1 to 1C represent various exemplary decorative electronic lamps 10A to 10D of the present invention, according to various embodiments described herein. Such decorative electronic lamps 10A to 10D illustrates arrangement of one or more stone portions in different defined patterns.

Referring to FIG. 1, illustrated is a first decorative electronic lamp 10A that may include two stone portions such as a first stone portion 12A and a second stone portion 12B. First stone portion 12A and second stone portion 12B may correspond to a single stone body aesthetically disintegrated in a defined pattern. An example of defined pattern may be positioning of first stone portion 12A as a top portion of first decorative electronic lamp 10A and second stone portion 12B as a bottom portion of first decorative electronic lamp 10A.

In an embodiment, such defined pattern may further include positioning of at least one light source 16, such as an LED lamp, on a top end of second stone portion 12B. Further, a glass cylinder 14 may be mounted over the top end of second stone portion 12B. Furthermore, first stone portion 12A may be mounted atop glass cylinder 14. The defined pattern may include first stone portion 12A, light source 16, and second stone portion 12B in such a manner that first decorative electronic lamp 10A seems to have a seamless and continuous aesthetic surface.

Referring to FIG. 1A, there is illustrated a second decorative electronic lamp 10B that may include two stone portions such as a first stone portion 18A and a second stone portion 18B. First stone portion 18A and second stone portion 18B may correspond to a single stone body aesthetically disintegrated in a defined pattern. An example of the defined pattern may be positioning of first stone portion 18A as a top portion of second decorative electronic lamp 10B and second stone portion 18B as a bottom portion of second decorative electronic lamp 10B.

In an embodiment, such defined pattern may further include positioning of at least one light source 20, such as an LED lamp, on top end of second stone portion 18B. Further, a plurality of support members 22 may be mounted over the top end of second stone portion 18B. Furthermore, first stone portion 18A may be mounted atop plurality of support members 22. The defined pattern may include first stone portion 18A, light source 20, and second stone portion 18B in such a manner that second decorative electronic lamp 10B seems to have a seamless and continuous aesthetic surface.

Referring to FIG. 1B, there is illustrated a third decorative electronic lamp 10C that may include two stone portions such as a first stone portion 24A and a second stone portion 24B. First stone portion 24A and second stone portion 24B may correspond to different stone bodies aesthetically arranged in a defined pattern, as illustrated in FIG. 1B. An example of the defined pattern may be positioning of first stone portion 24A arranged vertically on second stone portion 24B arranged laterally. In such a case, the upper surface of second stone portion 24B may be such that it provides a stable contact surface to first stone portion 24A, by use of an adhesive or the like.

In an embodiment, such defined pattern corresponds to a first aperture 26 through transverse surface of first stone portion 24A arranged vertically. At least one light source 28 may be positioned in first aperture 26. The defined pattern may include first stone portion 24A, light source 28, and second stone portion 24B in such a manner that third decorative electronic lamp 10C seems to have a seamless and continuous aesthetic appearance.

Referring to FIG. 1C, there is illustrated a fourth decorative electronic lamp 10D that may include one stone portion 30. Stone portion 30 may be aesthetically positioned in a defined pattern, as illustrated in FIG. 1C. An example of the defined pattern may be positioning of stone portion 30 either vertically or laterally. In an embodiment, such defined pattern may include a second aperture 32 through surface of stone portion 30. At least one light source 34 may be positioned in second aperture 32. The defined pattern may include stone portion 30 and light source 34, in such a manner that fourth decorative electronic lamp 10D seems to have a seamless and continuous aesthetic appearance.

Each of decorative electronic lamps 10A to 10D, as described above and illustrated in FIGS. 1 to 1C includes a wiring housing 36A, 36B, 36C, 36D, respectively. At least one stone portion of one or more stone portions includes a provision for installment of at least one light source, such as light sources 16, 20, 28 and 34. Wiring housing 36A, 36B, 36C, 36D may be configured to house electrical wires 38A, 38B, 38C, 38D extending from one or more light sources, such as light sources 16, 20, 28 and 34, to an electrical power supply 40 through one or more stone portions. In an embodiment, electrical wires 38A, 38B, 38C, 38D may be connected to a solar cell-type power source 40A. In another embodiment, electrical wires 38A, 38B, 38C, 38D are connected to an external electrical power source 40B.

In an embodiment, each of one or more stone portions, such as first stone portions 12A, 18A, and 24A, second stone portions 12B, 18B, and 24B, and stone portion 30, may be one of a regular shape or an irregular shape.

Such exemplary decorative electronic lamps 10A to 10D of present invention are presented in a new look, a new decor, having natural and environment-friendly design. The present invention may include a rock lamp comprising a first stone body having a transparent glass cylinder mounted on top and a second stone portion mounted atop the glass cylinder, wherein the first stone body has an aperture extending through the center from the top to the bottom for housing electrical wires which power at least one light emitting diode housed within the glass cylinder. The electrical wires may be connected to a solar cell-type power source or a conventional electrical power source external to the stone lamp body.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A decorative electronic lamp comprising:

one or more stone portions arranged in a defined pattern, wherein at least one stone portion of said one or more stone portions include a provision for installment of at least one light source of one or more light sources; and a wiring housing to house electrical wires extending from said one or more light sources to an electrical power supply through said one or more stone portions, wherein said electrical wires are connected to a solar cell power source, wherein said defined pattern corresponds to positioning of said at least one light source of one or more light sources on a top end of said at least one stone portion, said at least one light source protruding outwardly and being exposed from said top end.

2. The decorative electronic lamp of claim 1, wherein said one or more stone portions belong to a single stone body aesthetically disintegrated in said defined pattern.

3. The decorative electronic lamp of claim 2, wherein said defined pattern corresponds to mounting of a glass cylinder over said top end of said at least one stone portion, and mounting another stone portion on top said glass cylinder.

4. The decorative electronic lamp of claim 2, wherein said defined pattern corresponds to mounting of a plurality of support members over said top end of said at least one stone portion, and mounting another stone portion atop said plurality of support members.

5. The decorative electronic lamp of claim 1, wherein said one or more stone portions correspond to different stone bodies aesthetically arranged in said defined pattern.

6. The decorative electronic lamp of claim 5, wherein said defined pattern corresponds to an aperture through transverse surface of said at least one stone portion of said one or more stone portions, wherein said at least one light source is positioned in said aperture.

7. The decorative electronic lamp of claim 1, wherein said electrical wires are connected to an external electrical power source.

8. The decorative electronic lamp of claim 1, wherein each of said one or more stone portions are of a regular shape or an irregular shape.

9. The decorative electronic lamp of claim 1, wherein said wiring housing extends vertically within said at least one stone portion.

10. A decorative electronic lamp, comprising:

a) a first stone portion and a second stone portion arranged in a defined pattern, wherein said first stone portion is a top portion and said second stone portion is a bottom portion, said second stone portion including a provision for installment of at least one light source, wherein said at least one light source is mounted to a top end of said second stone portion, said at least one light source extending outwardly from said top end;

b) a wiring housing extending vertically within said second stone portion, said wiring housing extending from a bottom end of said second stone portion to a top end of said second stone portion, said wiring housing including electrical wires therein extending from said at least one light source to an electrical power supply, wherein said electrical power supply is a solar cell power source or an external electrical power source; and c) a glass cylinder mounted over said second top portion, said glass cylinder completely separating said first stone portion and said second stone portion, wherein said first stone portion is mounted over said glass cylinder to form a seal, wherein said first stone portion, said glass cylinder, and said second stone portion form a continuous surface.

* * * * *